United States Patent [19]

Lancellotti

[11] 4,135,720

[45] * Jan. 23, 1979

[54] GOLF PUTTER PRACTICE DEVICE

[76] Inventor: William E. Lancellotti, 371 Broadway, Providence, R.I. 02903

[ * ] Notice: The portion of the term of this patent subsequent to Sep. 7, 1993, has been disclaimed.

[21] Appl. No.: 720,620

[22] Filed: Sep. 3, 1976

[51] Int. Cl.[2] ..... A63B 69/36

[52] U.S. Cl. ..... 273/186 A; 273/194 A; 273/170; 273/1 M

[58] Field of Search ..... 273/186 A, 194 R, 194 A, 273/170, 163 R, 162 B, 186 R, 186 C, 184 R, 185 R, 164, 183 D, 1 M

[56] References Cited

U.S. PATENT DOCUMENTS

| | | | |
|---|---|---|---|
| 2,592,013 | 4/1952 | Curley | 273/170 |
| 3,130,762 | 4/1964 | Kerr | 273/170 |
| 3,498,616 | 3/1970 | Hurst | 273/186 A |
| 3,979,125 | 9/1976 | Lancellotti | 273/186 A |

*Primary Examiner*—George J. Marlo

*Attorney, Agent, or Firm*—Salter & Michaelson

[57] ABSTRACT

A golf putter practice device comprising a movable indicator and a plurality of separate depressions or channels with one of said depressions or channels defining a path normal to the face of the putter and with the other depressions or channels defining angular paths with respect to the putter face so that, upon impact with a golf ball, the momentum imparted to the indicator will cause it to move forwardly into one or more of the depressions or channels dependent upon the orientation of the putter in relation to the ball upon impact therewith. This enables corrections to be made to the putting stroke if the indicator shows that during the previous putt, the club face was not properly positioned with respect to the ball upon impact. The movable indicator may take the form of a steel ball which is retained in its initial position by a magnet. To avoid a distraction to the golfer, a pivotable plate or cover may be provided to obscure the indicator elements from view during the putting stroke.

14 Claims, 18 Drawing Figures

GOLF PUTTER PRACTICE DEVICE

BACKGROUND OF THE INVENTION

This invention is related to the invention covered by my copending U.S. application Ser. No. 630,659, filed Nov. 10, 1975, now U.S. Pat. No. 3,979,125, dated Sept. 7, 1976.

Various practice mechanisms are know to assist one in perfecting the putting stroke in golf. An important element in accomplishing accurate putting is the ability to squarely impact the ball with the face of the putter, i.e., the face of the putter upon impact with the ball should be square or normal to the intended path of the ball. It is accordingly desirable to be able to accurately determine what the orientation of the putter face to the ball was after each practice putt so that the golfer may be better trained to impace the ball squarely each time.

SUMMARY OF THE INVENTION

The present invention accompishes this aim by the provision of a golf putting device for improving one's putting stroke comprising indication means including a movable indicator, and a plurality of separate receiving channels or depressions orientated so that the indicator, which may be a liquid, such as mercury, or which may be a solid ball, will be thrust forwardly into one of the depressions of channels from its initial position when the ball is impacted by the putter. Where the indicator is a liquid, it may, upon impact, enter more than one channel, in which case the amount of liquid indicator received by any one channel will be dependent upon the alignment of the club face during impact; i.e., if the club face is square, all or most all of the indicator will flow straight forwardly into the center channel; whereas if the club face is closed or "hooded", most will flow into the left channel; while if the club face is open, most will flow into the rightside channel; assuming the player is right-handed. Means are further provided for retaining the amount of indicator fluid entering each channel so long as the putter remains in a generally horizontal disposition so that the impact position of the previous putt may be studied and corrections made prior to further practice putts being taken.

It is accordingly the primary object of the present invention to provide a practice device for improving one's putting stroke wherein the angular disposition of the club in relationship to the ball upon impact may be accurately determined after the ball is stroked.

A further object of the invention is the provision of a golf putting practice device, the presence of which may be concealed when not being utilized as a practice device.

Still another object of the invention is the provision of a golf putting practice device which may be detachably received by the putter head when desired to be used as a practice device and removed and/or concealed when not desired for use in practice, as when participating in a golf game.

Other objects, features and advantages of the invention will become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
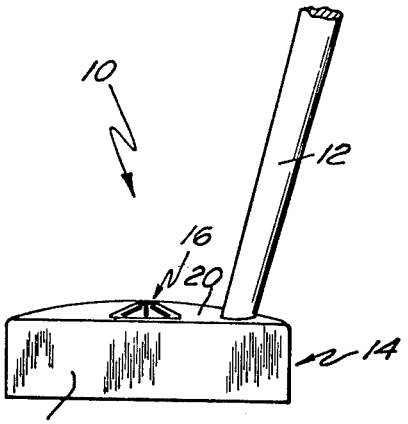
FIG. 1 is a perspective view of a conventional mallet heat type golf putter embodying the present invention.
Figure 2:
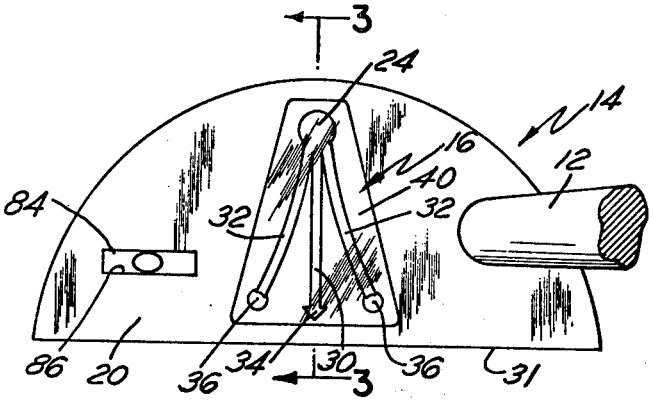
FIG. 2 is a top plan view thereof showing the relationship of the indication means of the present invention and its disposition within the club head.

In the drawings, and in particular FIGS. 1-5 thereof, a putter 10 having a shaft 12 and head 14 of a mallet-style configuration is depicted. The indication means 16 of the present invention is received in a suitably configured depression 18 formed in the top surface 20 of the head 14. The depression 18 includes a peripheral ledge 22 and a reservoir or recess 24 for receipt of indication fluid 26, preferably of a high-density material, such as mercury. THe forward face 28 of the reservoir 24 is smoothly upwardly inclined and merges into a plurality of separate indication receiving channels, including primary channel 30 which is disposed in a direction normal to the contact face 32 of the club head 14, and secondary channels 32 disposed on either side thereof. There may be a greater number of secondary channels than the two depicted in the drawings; although it is only necessary that enough secondary channels 32 be provided so that a proportionate amount of indication liquid be received in said channels upon impact, as will be hereinafter more fully explained.

As will be noted, the secondary channels 32 extend outwardly with respect to each other and from the primary channel 30. Both the primary and secondary channels in turn terminate in secondary reservoirs 34 and 36, respectively, which are spaced from each other by reason of the outward divergence of the secondary channels 32. The channels do, however, converge at the forward face 28 of the reservoir 24 wherein the channel 30 is shown separated from the secondary channels 32 by means of sharp edges 38 so as to reduce any impedence to the fluid 26 moving forwardly due to inertia after impact with the ball. More specifically, the edges 38 enable the fluid indication mass 26 to be sliced into proportional amounts depending on the alignment of the club face with the ball upon impact, thus resulting in a reduced possibility of error in the amount of liquid 26 received by a particular channel due to the cohesiveness of the material itself; i.e., liquids exhibiting high surface tension characteristics, such as mercury, tend to move as a single mass. Alternatively, the individual channels may communicate with the reservoir at slightly spaced but adjacent locations along the forward wall 28 thereof.

It should be noted that the angular disposition at which each channel communicates with the reservoir is slightly different, the primary channel 34 being disposed normal to the impact face 32 of the putter head 14, and the secondary channels 32 being disposed at angles slightly displaced from such normal or perpendicular disposition and on either side of the primary channel 30. In this manner, and assuming a prefectly normal or perpendicular alignment of the club face 31 to the ball at impact, the momentum or inertia imparted to the liquid 26 during that portion of the swing prior to impact forces the liquid 26, upon impact, to flow forwardly into the primary channel. Disposition of the club face 31 in a direction slightly offset from such desired squared realtionship will result in some or a greater amount of liquid 26 being forced forwardly into one of the secondary channels 32. Thus, after the ball has been stroked, the proportional amount of liquid 26 in each channel becomes an after-the-fact indication of how well the face of the club was squared with the ball during the stroke. The golfer may then make necessary corrections in swing, stance, grip and so forth during repetitive practice utilizing the present device so as to increase his or her skill in properly squaring the club face with the ball.

Figure 3:
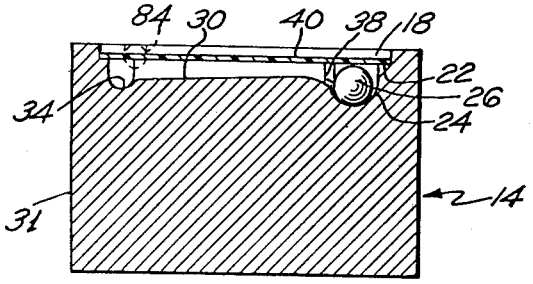
FIG. 3 is a side sectional view thereof taken along line 3—3 of FIG. 2.
Figure 4:
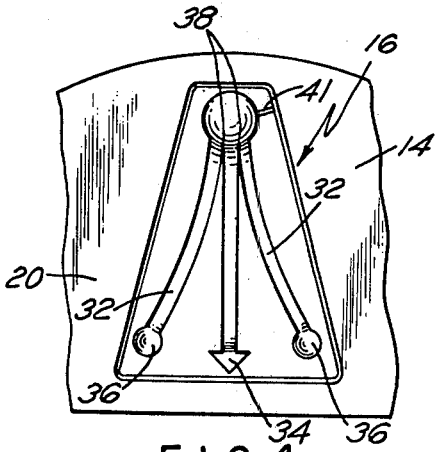
FIG. 4 is a partial plan view on an enlarged scale with the transparent cover plate removed.
Figure 5:
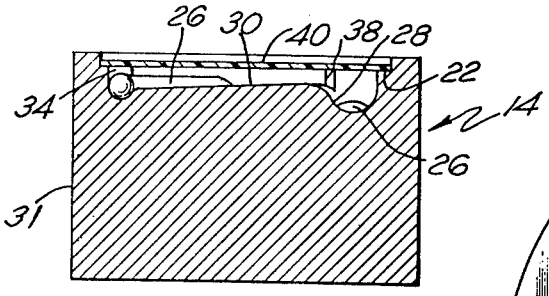
FIG. 5 is a side sectional view of the device similar to FIG. 3 but showing the position of the liquid indicator after a practice stroke has been taken and the inertial forces produced thereby have forced a portion thereof into one or more of the longitudinally orientated channels.

As will best be seen by comparison of FIGS. 3 and 5 of the drawings, each channel is gradually inclined downwardly not only so as to increase the flow of liquid 26 entering therein, but further to aid in retaining the amount of indicator liquid proportionately forced in a channel or channels after impact so as to maintain such positive indication for review by the golfer prior to the next stroke. In order that the indicator liquid does not spill from the reservoir and channels, and to reduce possible evaporation therefrom, a transparent cover 40 is tightly fixed over the upper portions thereof in contact with ledge 22 by known attachment means, such as adhesive connection or heat welding. Also, an air vent 41 connecting the reservoir 24 to atmosphere so as to prevent a partial vacuum from occurring therein when the liquid 26 moves therefrom into the channels may be provided.

Figure 6:
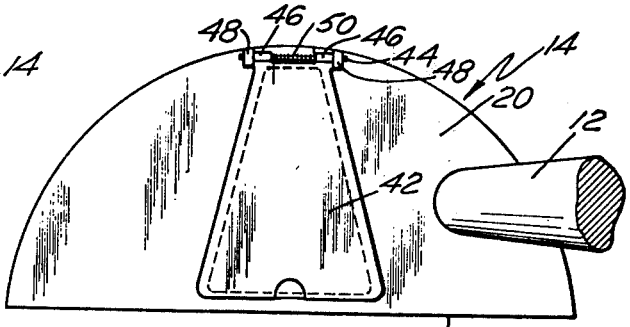
FIG. 6 is a top plan view of a putter heat showing an alternate embodiment of the present invention.
Figure 7:
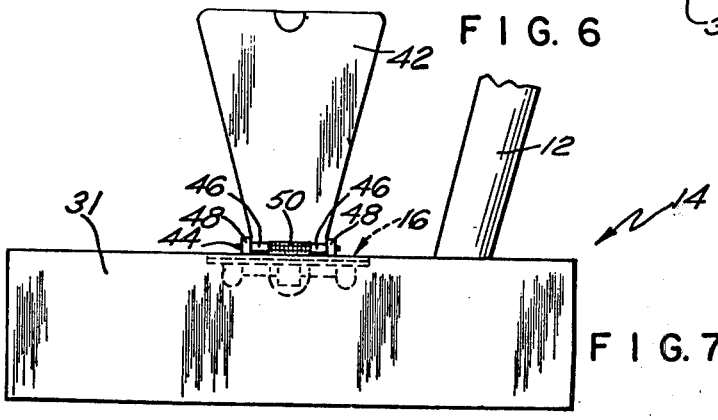
FIG. 7 is a front elevational view of the embodiment shown in FIG. 6 with the cover portion thereof in raised condition.

Upon occasion, the presence of the indication means 16 and the movement of the fluid 26 therein may form a distraction to the golfer while participating in a normal golf game rather than the practice thereof. Accordingly, and as is particularly shown in FIGS. 6 through 12 of the drawings, means are provided whereby the indication means 16 may either be removed from the putter entirely or obscured from active view when desired. Thus, in the embodiment shown in FIGS. 6 and 7, a plate or cover 42 is pivotally attached to the upper surface 20 of the club head 14 in such a manner that the cover, when closed, will obscure the indication means 16 as shown in FIG. 6. When it is desirable to resume putting practice, the cover 42 may be upwardly moved to again expose the indication means 16. The cover 42 is attached to the club head 14 by means of a pintle 44 received in spaced terminal rolled edges 46 in turn positioned in trunions 48 connected to the upper surface 20 of the club 14. A spring 50 serves to resiliently maintain the cover 42 in either open or closed position.

Figure 8:
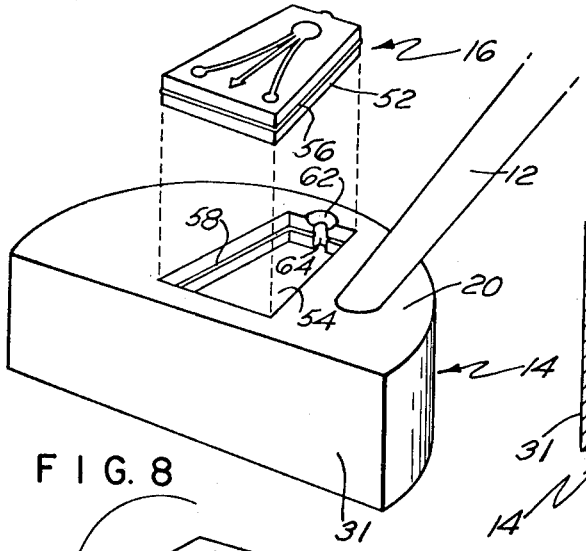
FIG. 8 is an exploded perspective view of a further embodiment of the present invention wherein the indication means is provided in a separate member which is detachable from the putter head.
Figure 9:
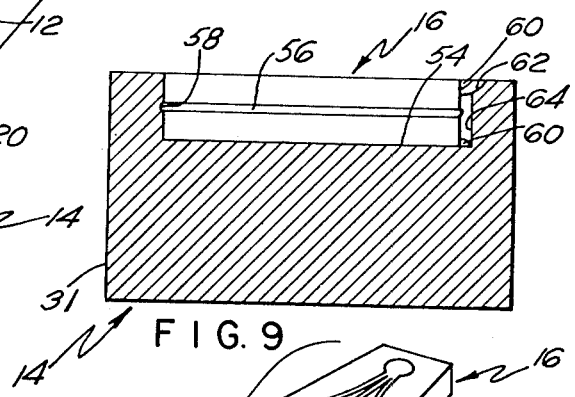
FIG. 9 is a side sectional view of the putter head shown in FIG. 8.

Turning now to FIGS. 8 and 9 of the drawings, an embodiment is depicted wherein the indication means 16 is entirely self-contained in a separate member 52. Such member is adapted to be received in a depression 54 of similar peripheral shape as the member 52 and of a depth to accommodate such. The periphery of the member 52 includes an outwardly extending rib 56 which is adapted to be cooperatively engaged in a groove 58 formed around the periphery of the depression 54 so that the member is retained therein. The member 52 is further provided at an edge thereof with a pair of spaced ledges 60 disposed above a relief well 62 formed in the upper surface 20 of the club 14 whereby finger engagement by the golfer enables the member 52 to be removed from the depression 54 with ease. A vertically orientated notch 64 is disposed within that wall proximate the ledges 60 to receive the same. It will be thus apparent that in such embodiment the separate member 52 may be disposed face up when it is desired to use the device for practice putting and the like and thereafter removed by means of one of the ledges 60, turned face down and repositioned in the depression 54 so that the indication means 16 is not visible. In such alternate position the club may be used in a normal manner without either the possible distraction from the indication means to the golfer himself and without those with whom he is playing having knowledge of the device.

Figure 10:
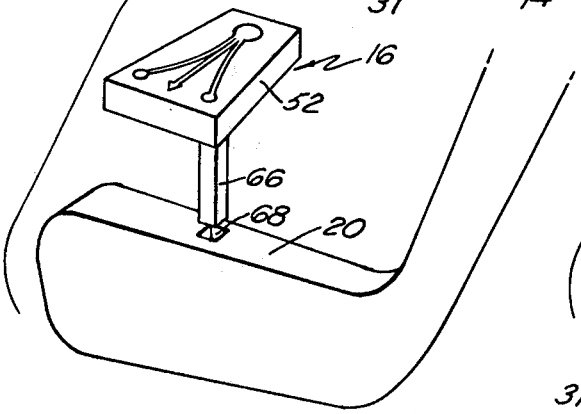
FIG. 10 is an exploded perspective view of a still further embodiment of the present invention.
Figure 11:
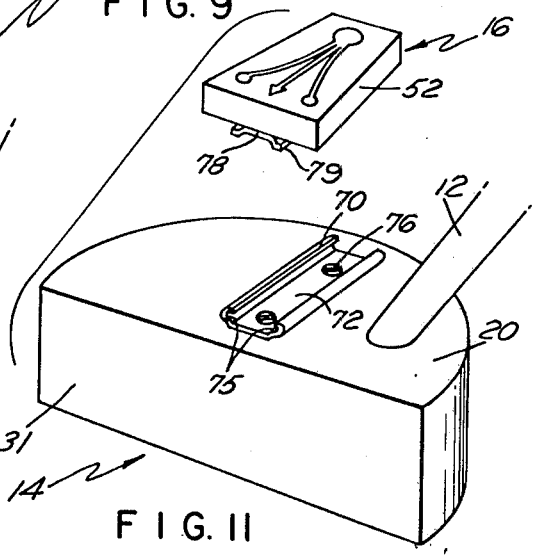
FIG. 11 is an exploded perspective view showing still another embodiment of the present invention.
Figure 12:
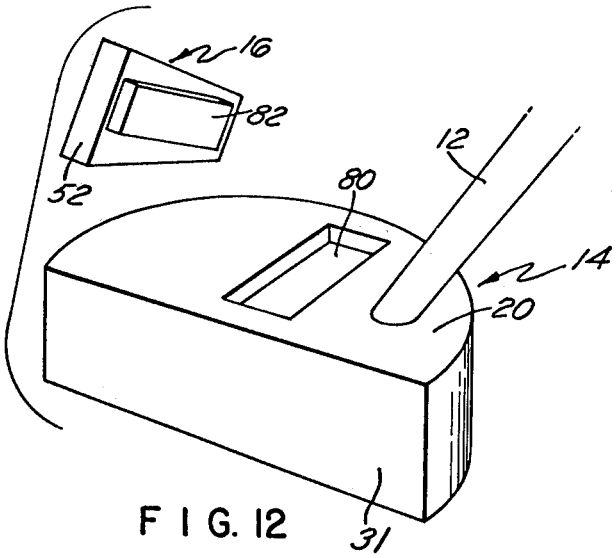
FIG. 12 is an exploded perspective view depicting still another embodiment thereof.
Figure 13:
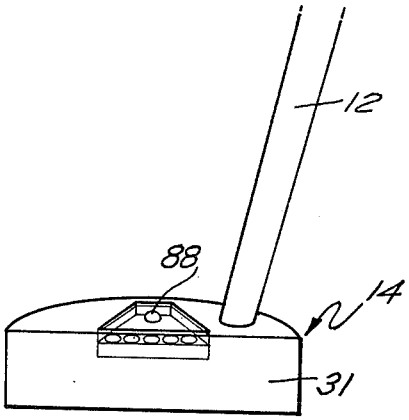
FIG. 13 is a perspective view of a golf putter showing a further modified form of the present invention.
Figure 14:
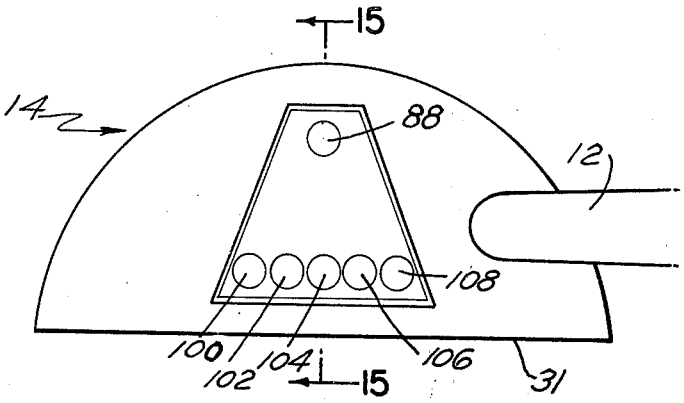
FIG. 14 is a top plan view thereof.

FIGS. 10 through 12 of the drawings depict further alternate embodiments wherein a separable member 52 containing indication means 16 is entirely detachable from the putter when it is desired to use the putter during normal play. In FIG. 10, the under surface of the member 52 is provided with a post or shaft 66 downwardly extending therefrom and adapted for receipt by an opening 68 provided in the top surface of the putter. In such embodiment, the putter may be of a conventional blade-type configuration, there being no need for the longitudinal extent required for receipt of the indication means as in the mallet-type configuration shown in the other embodiments. The post 66 is of plural-wall configuration, i.e., of rectangular, square or triangle cross-sectional configuration, and the opening 68 is similarly configured so as to insure proper positioning of the member 52 with respect to the putter face.

A similar detachment means is shown in FIG. 11 of the drawings wherein a keyway 70 having a base 72 and upwardly directed channel portions which define opposed grooves 75 is affixed to the top surface of the club by screws 76 or the like. The bottom side of the member 52 in this embodiment is provided with a key member 78 having outwardly flared ribs 79 for receipt in the keyway grooves 75. In this manner, the, the member 52 is adapted to be attached to the club head by the sliding engagement provided by the key and keyway means. One end of the keyway 70 may be narrower than the other so as to provide a wedging actiion to insure a more positive connection.

FIG. 12 of the drawings utilizes magnetic attachment means. Therein a depressiion 80 is provided in the top surface 20 of the club head 14 and a magnet 82 is affixed by conventional means, such as adhesive connection, to the underside of the separate member 52. The separate member 52 with the indication means 16 contained in the top surface thereof is then placed in the depression 80 and held therein by means of the magnetic attraction, assuming, of course, as in the present case, and as is usually conventional, that club head 14 is constructed of a ferrous metal. Alternatively, a magnet could be cemented or otherwise secured to the top surface of a conventional putter head for receiving the ferrous bottom of member 52 in magnetic relation. In such an arrangement, suitable flanges could be provided at the bottom of member 52 for snugly encircling the magnet to insure proper positioning and orientation of member 52.

In order to better assure that the club head 14 is generally disposed horizontal to the putting surface, i.e, is lying perfectly flat on the surface, it has been found desirable to provide a spirit level 84. The level may be of the self-contained type, that is, including a fluid medium disposed in a sealed platic tube and received in a pocket 86 provided in the top surface 20 of the putter head, or, alternatively, the level 84 may be provided as a part of member 52 by being mounted in a suitable cavity therein. It will also be noted that the cross-sectional configuration of the individual channels 30 and 32 is preferably rounded and may be coated with an anti-friction material, such as Teflon, to better enable the flow of indicator fluid 26 therein.

Whereas the form of my invention illustrated in FIGS. 1–12 and hereinbefore described utilizes fluid indicator means, the same concept and operation may be carried out using a small solid ball 88, preferably of steel. The ball 88 is positioned within a housing 90 having a base portion 92, side walls 94, and a top wall 96. The housing 90 may be constructed of any suitable material, such as plastic, and at least the top wall 96 is transparent so that movement of the ball 88 therein may be readily viewed.

Base portion 92 is provided with a dished recess 98 located at the end of housing 90 remote from the putter surface 31. At the opposite end of housing 90, i.e., the end most closely adjacent to putter surface 31, the base portion 92 is provided with a series of dished recesses 100, 102, 104, 106 and 108. As will be seen most clearly in FIGS. 15 and 16, the recesses 98, 100, 102, 104, 106 and 108 are all dimensioned so as to snugly receive ball 88, but the depth of said recesses is substantially less than one-half the thickness of the ball, whereupon the ball may be easily dislodged from the recesses, as will hereinafter be described.

Figure 15:
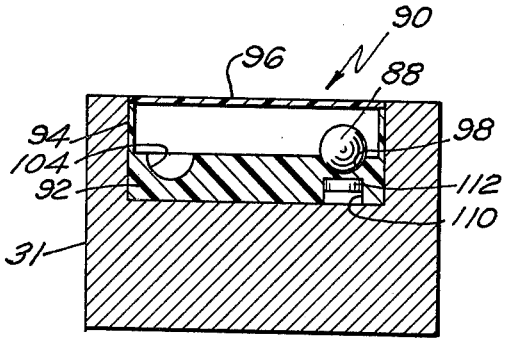
FIG. 15 is a section taken on line 15—15 of FIG. 14.
Figure 16:
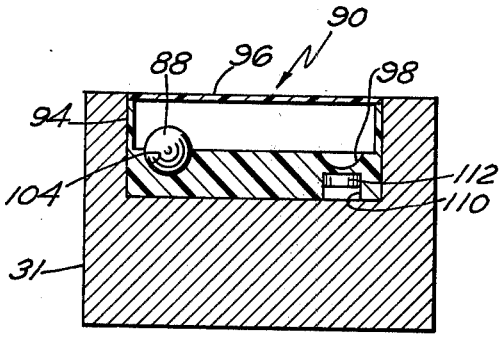
FIG. 16 is a section similar to FIG. 15 but showing the ball indicator after it has moved to operative position.

As will be seen most clearly in FIGS. 15 and 16, the undersurface of base portion 92 is provided with a bore 110 in which is mounted a small disc-like magnet 112, it being important to note that the magnet 112 is located directly beneath the recess 98.

In operation and use, it will be understood that the ball indicator 88 functions in much the same manner as does the fluid indicator 26 hereinbefore described. More specifically, the ball 88 is normally positioned in recess 98 and is releasably maintained in said position by the magnet 112 which tends to maintain the steel ball in this position due to the magnetic force exerted thereon. As the player brings the putter head rearwardly and then strokes it forwardly, the ball 88 remains in recess 98 until the putter face 31 makes impact with the golf ball, at which time the impact causes ball 88 to dislodge from recess 98 and move forwardly toward the recesses 100, etc. If the putter face 31 is perfectly square when making impact with the golf ball, the indicator ball 88 will move straightforward to recess 104 and will seat therein. Conversely, if the putter face is either open or closed at point of impact, the indicator ball 88 will move either to the left or right into one of the other forwardly disposed recesses in exactly the same manner that the fluid indicator 26 moves forward, as hereinbefore described. Depending on which of the forwardly disposed recesses in which the ball comes to rest, the player is able to ascertain just what the disposition was of the putter face at point of impact with the golf ball. After completing the stroke, the player may easily dislodge the ball 88 from whichever recess it has come to rest in, and by properly tilting the putter head 14, the ball will be caused to roll rearwardly to once again position itself in recess 98.

Figure 17:
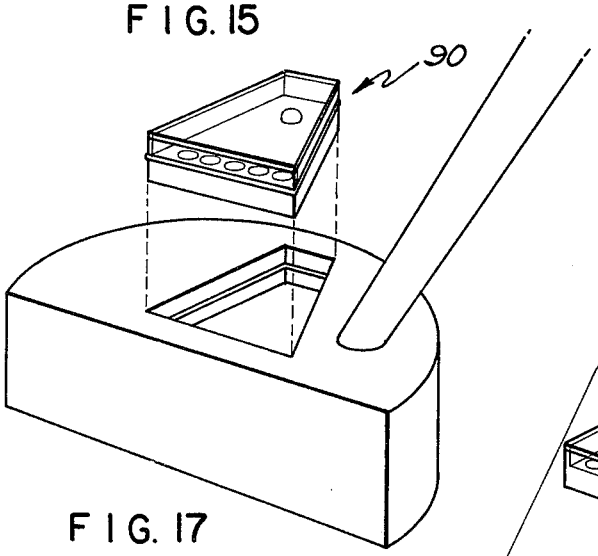
FIG. 17 is an exploded perspective view illustrating one form of attachment of the indicating means to the putter head.
Figure 18:
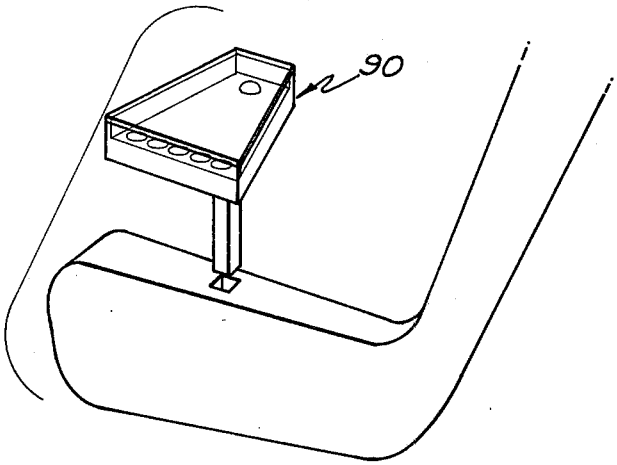
FIG. 18 is an exploded perspective view illustrating one form of attachment of the indicating means to a blade putter.

FIG. 17 illustrates a detachable mounting for the housing 90 in putter head 14, in precisely the same manner as shown in FIG. 8 and hereinbefore described. FIG. 18 likewise illustrates how the housing 90 may be mounted on a blade putter and once again is identical to the mounting illustrated in FIG. 10 and heretofore described. Actually, it will be understood that all of the mounting means illustrated and described in connection with FIGS. 1–12 are equally applicable to the modified form of my invention wherein the ball indicator 88 is used in place of the fluid indicator 26.

It is thus apparent that the various constructional embodiments of the present invention enable accurate after-the-fact determination of the manner in which the club face was aligned with respect to the ball during a practice putting stroke, thus enabling the golfer, through use of the subject device, to become more adept at squaring up the club face when striking the ball, thus assuring that the club face is disposed in a plane normal to the intended path of the ball. The present invention further assures that such practice can be accomplished in combination with a putter that can also be used for general golf play purposes inasmuch as the indication means thereof can be either obscured from view during such use or entirely removed therefrom.

While there is shown and described herein certain specific structures embodying the invention, it will be manifest to those skilled in the art that various modifications of the parts may be made without departing from he spirit and scope of the underlying inventive concept and that the same is not limited to the particular forms herein shown and described except insofar as indicated by the scope of the appended claims.

What is claimed is:

1. A golf putter practice device comprising indication means including a first area for receiving a movable indicator, a plurality of separate indicator receiving areas, means operatively associating said indicating means with the top surface of the putter so as to be viewable by the golfer and wherein said first area is disposed toward the rear edge of the putter and the separate areas are disposed toward the front or hitting edge of the putter, whereby momentum transmitted to said indicator during a putting stroke and upon impact with a ball serves to dislodge the indicator from said first area into one of said other areas depending upon the alignment of the putter face and the ball during impact, said indicator comprising a non-liquid, unitary solid ball.

2. The device set forth in claim 1 wherein said first area and said separate areas are all dished depressions which releasably receive said solid ball.

3. The device set forth in claim 1 wherein said solid ball is steel and wherein magnetic means are mounted adjacent said first area to normally maintain said ball thereon, except when dislodged pursuant to impact between the putter and a golf ball.

4. The device set forth in claim 1, said first area and said other areas disposed in a separate member and means for attaching said member to said putter.

5. The device set forth in claim 4, said attachment means comprising a plural-sided post downwardly extending from said member adapted to be received in a correspondingly shaped opening in the putter.

6. The device set forth in claim 4, said attachment means including magnetic means.

7. The device set forth in claim 6, said attachment means comprising a magnet attached to an underside of said member and receivable in a recess formed in the upper surface of said putter.

8. The device set forth in claim 4, said attachment means comprising a keyward upwardly extending from the top surface of said putter and longitudinally orientated normal to the face thereof, and a key attached to an underside of said member, said key slidably receivable in said keyway.

9. The device set forth in claim 1, including means connected therewith for selectively blocking observation of said indication means.

10. The device set forth in claim 9, said blocking means comprising a cover connected to said putter and movable between closed and open positions.

11. The device set forth in claim 1, said indication means comprising a separate member having top and bottom surfaces, said other first area and said areas disposed in said top surface, and a recess in said putter for receiving said member, said member being selectively mountable with either said top or bottom surface upwardly disposed.

12. The device set forth in claim 11, said putter recess having a peripheral extent equal to that of said member for receipt thereof, and means including a peripheral groove in said recess and a peripheral rib on said member adapted for receipt in said groove for releasably maintaining said member in said putter recess.

13. The device set forth in claim 11, a pair of spaced finger-engageable ledges outwardly extending from the periphery of said member adjacent the top and bottom surfaces thereof, and a notch outwardly extending from the periphery of said putter recess, said ledges received in said notch.

14. The device set forth in claim 1, including a spirit level mounted on said putter, said spirit level observable during practice use of said putter to insure that the putter bottom is lying flat on the putting surface.

* * * * *